US008055162B2

(12) United States Patent
Ohgoshi et al.

(10) Patent No.: US 8,055,162 B2
(45) Date of Patent: Nov. 8, 2011

(54) TONER BOTTLE AND APPARATUS FOR IMAGE FORMATION

(75) Inventors: Toshihide Ohgoshi, Nara (JP); Koichi Mihara, Fujiidera (JP); Hideaki Kurimoto, Yamato-koriyama (JP); Hiroshi Kubota, Kadoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 657 days.

(21) Appl. No.: 12/130,734

(22) Filed: May 30, 2008

(65) Prior Publication Data

US 2008/0298846 A1 Dec. 4, 2008

(30) Foreign Application Priority Data

May 31, 2007 (JP) ..... 2007-145184

(51) Int. Cl.
*G03G 15/00* (2006.01)
*G03G 15/06* (2006.01)
*G03G 15/08* (2006.01)

(52) U.S. Cl. ..... 399/263; 399/262

(58) Field of Classification Search ..... 399/258, 399/262, 263

See application file for complete search history.

(56) References Cited

U.S. PATENT DOCUMENTS 5,774,772 A 6/1998 Kai et al.
5,995,789 A * 11/1999 Murakami et al. ..... 399/262
7,162,190 B2 * 1/2007 Deguchi ..... 399/258
2006/0034642 A1 2/2006 Taguchi et al.
2006/0222414 A1 10/2006 Yamamura

FOREIGN PATENT DOCUMENTS

JP 63139379 A * 6/1988
JP 07333971 A * 12/1995
JP 8-179612 7/1996
JP 09034233 A * 2/1997
JP 9-62081 A 3/1997
JP 10-123813 A 5/1998
JP 11-305531 11/1999
JP 2000-147887 A 5/2000
JP 2002214893 A * 7/2002
JP 2006-53446 2/2006
JP 2006-276615 A 10/2006

* cited by examiner

*Primary Examiner* — David Gray
*Assistant Examiner* — Fred L Braun
(74) *Attorney, Agent, or Firm* — Nixon & Vanderhye P.C.

(57) ABSTRACT

A toner bottle for containing toner has a cylindrical body and a scraper. The bottle body can be rotated on its axis by a driving source. The scraper is supported movably in the bottle body. The bottle body has an opening and ribs. The toner in the toner bottle is supplied through the opening to a developing unit. When the bottle body rotates, the ribs convey the toner toward the opening. The scraper includes a shaft and a scraping part. The shaft extends over the whole length of the bottle body and supports the scraping part. A portion of the scraping part is in contact with the inner cylindrical surface of the bottle body. When the bottle body rotates, the scraper moves perpendicularly to the axis of the body.

11 Claims, 9 Drawing Sheets

TONER BOTTLE AND APPARATUS FOR IMAGE FORMATION

CROSS REFERENCE

This Nonprovisional application claims priority under 35 U.S.C. §119(a) on Patent Application No. 2007-145184 filed in Japan on May 31, 2007, the entire contents of which are hereby incorporated by reference.

BACKGROUND OF THE TECHNOLOGY

The present technology relates to a toner bottle for containing toner which is supplied to a developing unit. The technology also relates to an apparatus for image formation.

An apparatus for electrophotographic image formation includes a toner storage station and a developing unit. The toner storage station includes toner boxes supported removably in it. The toner boxes can be rotated to supply the developing unit with toner, to which colloidal silica or the like is added to improve its flowability.

In recent years, apparatus for image formation forms finer images at higher speeds with toner smaller in particle diameter. The smaller toner is lower in flowability and liable to cohere in the toner boxes of the apparatus. Some toner boxes have ribs formed on their inner surfaces. The ribs convey toner when the toner boxes rotate. The toner has a great tendency to move slowly and cohere between the ribs.

JP 2006-53446 A discloses a toner bottle fitted with a coil or another conveying member in it, which conveys toner toward the opening of the bottle. The main body of the toner bottle does not rotate, but the conveying member does. Accordingly, toner is liable to remain in the ends of the bottle body and on the inner surface of the body, so that toner is liable to cohere in the body.

JP H11-305531 A discloses a toner bottle fitted with a loosening member near the opening of its main body. The loosening member restrains toner from cohering only near the body opening. One end of the loosening member is fixed to the bottle body. Accordingly, the movement of the loosening member is restricted, so that this member is insufficiently effective in loosening the toner. In particular, near the end of the bottle body where the loosening member is fixed, toner can hardly be loosened, so that it is liable to cohere.

An object is to provide a rotating toner bottle which restrains the cohesion of toner over its whole length. Another object is to provide an apparatus for image formation fitted with such a toner bottle.

SUMMARY OF THE TECHNOLOGY

A toner bottle contains toner and has a cylindrical body and a scraper. The bottle body can be rotated on its axis by a driving source. The scraper is supported movably in the bottle body. The bottle body has an opening and ribs. The toner in the toner bottle is supplied through the opening to a developing unit. When the bottle body rotates, the ribs convey the toner toward the opening. The scraper includes a shaft and a scraping part. The shaft extends over the whole length of the bottle body and supports the scraping part. A portion of the scraping part is in contact with the inner cylindrical surface of the bottle body. When the bottle body rotates, the scraper moves perpendicularly to the axis of the body.

The scraper movement makes the scraping part scrape off the toner on the inner cylindrical surface of the bottle body over the whole length of the body. This improves the flowability of the toner over the whole length of the bottle body, inclusive of the spaces between the ribs.

DETAILED DESCRIPTION OF THE TECHNOLOGY

The best mode of carrying out the technology will be described below with reference to the accompanying drawings.

Figure 1:
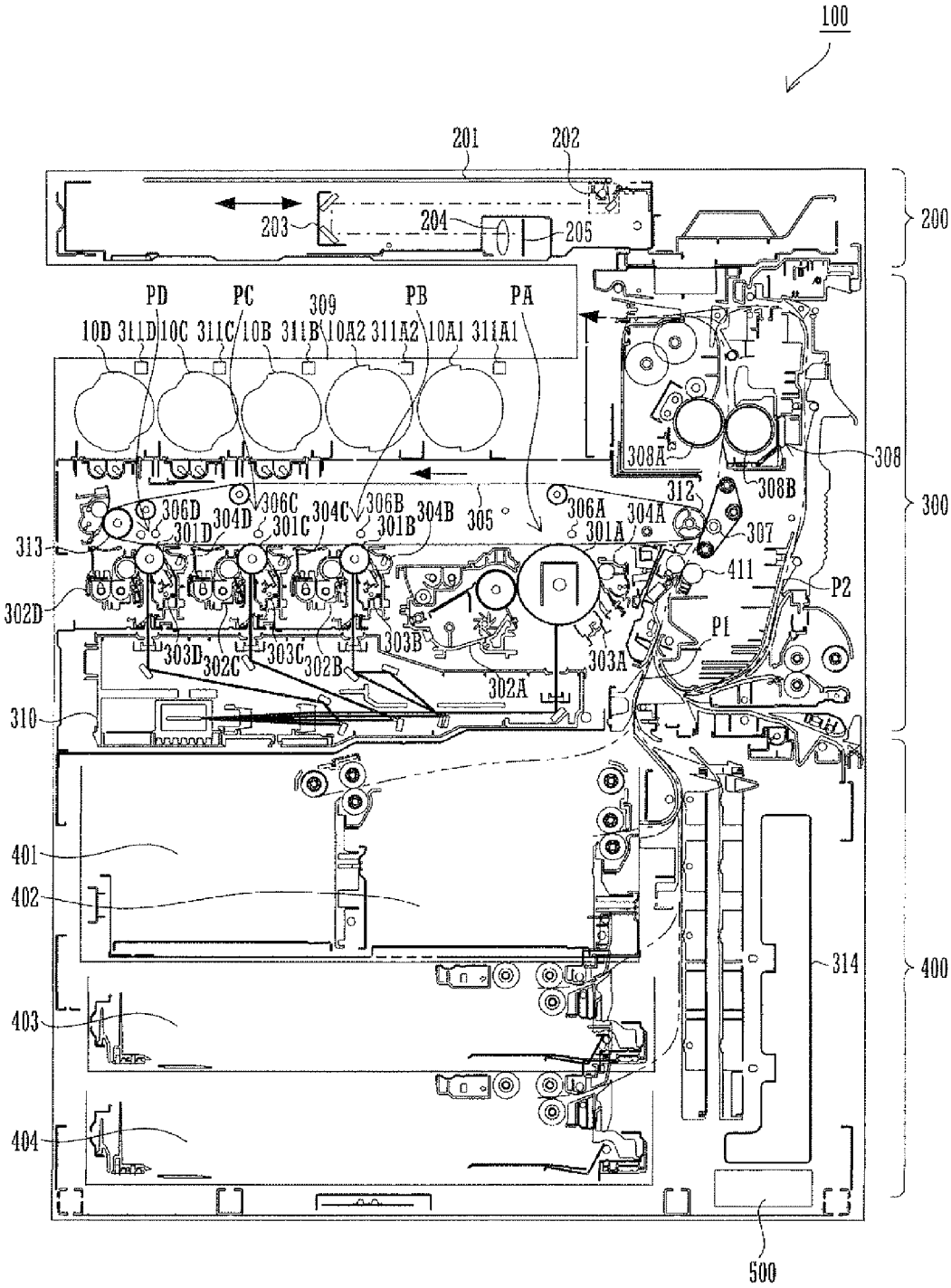
FIG. 1 is a sectional front view of an apparatus for image formation.

With reference to FIG. 1, an apparatus for image formation 100 includes an image reading station 200, an image recording station 300, a paper feeding station 400, and a control unit 500.

The image reading station 200 includes a document platform 201, a first mirror base 202, a second mirror base 203, an imaging lens 204, and a CCD (charge coupled device) 205.

The document platform 201 is a hard glass plate.

The mirror bases 202 and 203 are supported horizontally movably under the document platform 201. The speed at which the second mirror base 203 moves is ½ of the speed at which the first mirror base 202 moves. The first mirror base 202 carries a light source and a first mirror. The second mirror base 203 carries a second mirror and a third mirror.

The mirror bases 202 and 203 move horizontally under the document platform 201 so that the image on the document on the platform can be read. The light source on the first mirror base 202 radiates light to the under side of the document on the platform 201. The light reflected by this side of the document is then reflected by the first mirror on the first mirror base 202 toward the second mirror base 203.

The light reflected by the under side of the document is incident on the CCD 205 via the imaging lens 204 by means of the second and third mirrors on the second mirror base 203, with the optical path length kept constant.

The CCD 205 outputs an electric signal representing the quantity of light reflected by the under side of the document. The electric signal is input as image data into the image recording station 300.

The image recording station 300 includes an exposure unit 310, a monochromatic (K) image forming unit PA, a cyan (C) image forming unit PB, a magenta (M) image forming unit PC, a yellow (Y) image forming unit PD, an intermediate transfer belt 305, a secondary transfer roller 307, a fixing unit 308, paper passages P1 and P2, a delivery tray 309, toner bottles 10A1, 10A2 and 10B-10D, and driving sources 311A1, 311A2 and 311B-311D.

The image forming units PA-PD are similar in structure and perform image formation based on monochromatic, cyan, magenta, and yellow image data, respectively. Cyan, magenta, and yellow are the subtractive primaries, which can be obtained by means of the color separation of color images.

Each of the toner bottles 10A1, 10A2 and 10B-10D is supported removably by a bottle holder and contains toner. If it is detected that any one of the toner bottles 10A1, 10A2 and 10B-10D is empty, the empty bottle may be replaced with another toner bottle having the same shape and containing the same toner as the empty bottle has and contained respectively.

Each of the toner bottles 10A1 and 10A2 contains a black toner, which can be supplied through a supply passage (not shown) to the developing unit 302A. The toner bottles 10B-10D contain a cyan toner, a magenta toner, and a yellow toner, respectively, which can be supplied through supply passages (not shown) to the developing units 302B-302D respectively.

The driving sources 311A1, 311A2 and 311B-311D rotate the toner bottles 10A1, 10A2 and 10B-10D respectively in a specified bottle rotating direction.

The image forming units PA-PD are arranged in a row along the intermediate transfer belt 305 and include photosensitive drums 301A-301D respectively, developing units 302A-302D respectively, charging units 303A-303D respectively, primary transfer rollers 306A-306D respectively, and cleaning units 304A-304D respectively.

WA The photosensitive drum 301A of the monochromatic image forming unit PA is larger in diameter than the other drums 301B-301D. It is strongly demanded that monochromatic image formation, which only the monochromatic image forming unit PA performs, be high in speed. In addition, monochromatic image formation is performed more often than color image formation, which all the image forming units PA-PD perform. Therefore, it is necessary that the drum 301A be longer in life than the drums 301B-301D.

The photosensitive drums 301B-301D are equal in diameter. Accordingly, the distance between the axes of the drums 301A-301B is longer than the distance between the axes of the drums 301B and 301C and the distance between the axes of the drums 301C and 301D.

The charging units 303A-303D are similar in structure and charge the cylindrical surfaces of the photosensitive drums 301A-301D respectively and uniformly to a specified potential.

The exposure unit 310 includes semiconductor lasers, a polygon mirror, a first fθ lens, and a second fθ lens, which are not shown, and irradiates the cylindrical surfaces of the photosensitive drums 301A-301D with laser beams modulated with monochromatic, cyan, magenta, and yellow image data, respectively. The irradiation forms, on the cylindrical surfaces of the drums 301A-301D, electrostatic latent images based on the monochromatic, cyan, magenta, and yellow image data, respectively.

The developing units 302A-302D supply the black, cyan, magenta and yellow toners to the cylindrical surfaces of the photosensitive drums 301A-301D respectively on which the electrostatic latent images have been formed. This converts the latent images into monochromatic, cyan, magenta, and yellow developer images, which are visible.

The cleaning units 304A-304D recover the toners remaining on the cylindrical surfaces of the photosensitive drums 301A-301D respectively after the development and image transfer.

The intermediate transfer belt 305 runs in a loop over a driving roller 312 and a driven roller 313. The driving roller 312 drives this belt 305 counterclockwise in FIG. 1. The primary transfer rollers 306A-306D are supported inside the belt 305 over the photosensitive drums 301A-301D respectively. The position where the belt 305 faces each of the drums 301A-301D is a primary transfer position.

A primary transfer bias is applied to the primary transfer rollers 306A-306D by means of constant-voltage control. This transfer bias is opposite in polarity to the electrification of the toners. This transfers the developer images on the photosensitive drums 301A-301D successively in a superposed fashion to the outer surface of the intermediate transfer belt 305, forming a full color developer image on this surface.

If only part of monochromatic, cyan, magenta, and yellow image data are input into the image recording station 300, one or more electrostatic latent images and developer images are formed only on the photosensitive drum or drums associated with the input data. For example, in the monochromatic printing mode, an electrostatic latent image and a developer image are formed only on the photosensitive drum 301A, so that only the monochromatic developer image is transferred to the intermediate transfer belt 305.

For full color image formation, all the image forming units PA-PD form images, with the primary transfer rollers 306A-306D bringing the intermediate transfer belt 305 into compressive contact with the cylindrical surfaces of the photosensitive drums 301A-301D respectively. For monochromatic image formation, only the image forming unit PA forms an image, with the primary transfer roller 306A bringing the intermediate transfer belt 305 into compressive contact with the cylindrical surface of the drum 301A.

Each of the primary transfer rollers 306A-306D includes a metallic shaft and an electrically conductive elastic member. The metallic shaft has a diameter of 8-10 mm and may be made of stainless steel. The elastic member covers the metallic shaft and may be made of EPDM (ethylene-propylene copolymer rubber) or urethane foam. A high voltage is applied uniformly to the intermediate transfer belt 305 through the primary transfer rollers 306A-306D.

The developer images transferred to the outer surface of the intermediate transfer belt 305 in the primary transfer positions are carried by this belt to the secondary transfer position between this belt and the secondary transfer roller 307. During image formation, this transfer roller 307 is, under a specified nip pressure, in compressive contact with the outer surface of the intermediate transfer belt 305 whose inner surface contacts the outer surface of the driving roller 312.

When a sheet of paper fed from the feeding station 400 passes through the nip between the intermediate transfer belt 305 and the secondary transfer roller 307, a high voltage is applied to the secondary transfer roller 307. This voltage is opposite in polarity to the toner electrification. This transfers the developer image on the intermediate transfer belt 305 to the passing sheet.

The fixing unit 308 includes a heating roller 308A and a pressing roller 308B. After the developer image is transferred to the sheet, the sheet passes through the nip between these rollers 308A and 308B so as to be heated and pressed. This fixes the developer image fast on the sheet. After the developer image is fixed, the sheet is discharged onto the delivery tray 309.

The paper passage P1 leads substantially vertically from the feeding station 400 through the secondary transfer position between the intermediate transfer belt 305 and the secondary transfer roller 307, and through the fixing unit 308, to the delivery tray 309.

The paper passage P2 leads from the upper side of the fixing unit 308 to the lower side of the secondary transfer position between the intermediate transfer belt 305 and the secondary transfer roller 307. The upper side of the fixing unit 308 and the lower side of the secondary transfer position are downstream and upstream respectively in the conveying direction in which sheets of paper pass through the passage P1. A sheet of paper having passed the fixing unit 308 can be conveyed through the passage P2, with its previously trailing end leading. This feeds the sheet, with its front side back, again to the secondary transfer position.

The feeding station 400 includes feed cassettes 401-404, each of which holds sheets of paper of a size. The feeding station 400 feeds sheets of paper one by one from one of the cassettes 401-404. A sheet of paper from the feeding station 400 is conveyed along the passage P1 to the secondary transfer position between the intermediate transfer belt 305 and the secondary transfer roller 307.

The image recording station 300 further includes a pair of registration rollers 411 supported on the under side of the secondary transfer position between the intermediate transfer belt 305 and the secondary transfer roller 307. The axes of the registration rollers 411 are perpendicular to the conveying direction. With the registration rollers 411 pausing, the leading end of the sheet from the feeding station 400 is thrust against the nip between these rollers 411. If the sheet is angled with the conveying direction, the end thrusting regulates the position of the sheet.

The registration rollers 411 start rotating to feed the sheet to the secondary transfer position between the intermediate transfer belt 305 and the secondary transfer roller 307 at such a timing that the leading end of the sheet registers with the leading end of a developer image formed on the intermediate transfer belt 305. After the developer image is transferred to the sheet and fixed to it in the secondary transfer position, the sheet is discharged onto the delivery tray 309.

The apparatus 100 further includes a waste toner box 314 fitted in its bottom, which contains the toner recovered from the photosensitive drums 301A-301D by the cleaning units 304A-304D respectively.

Figure 2:
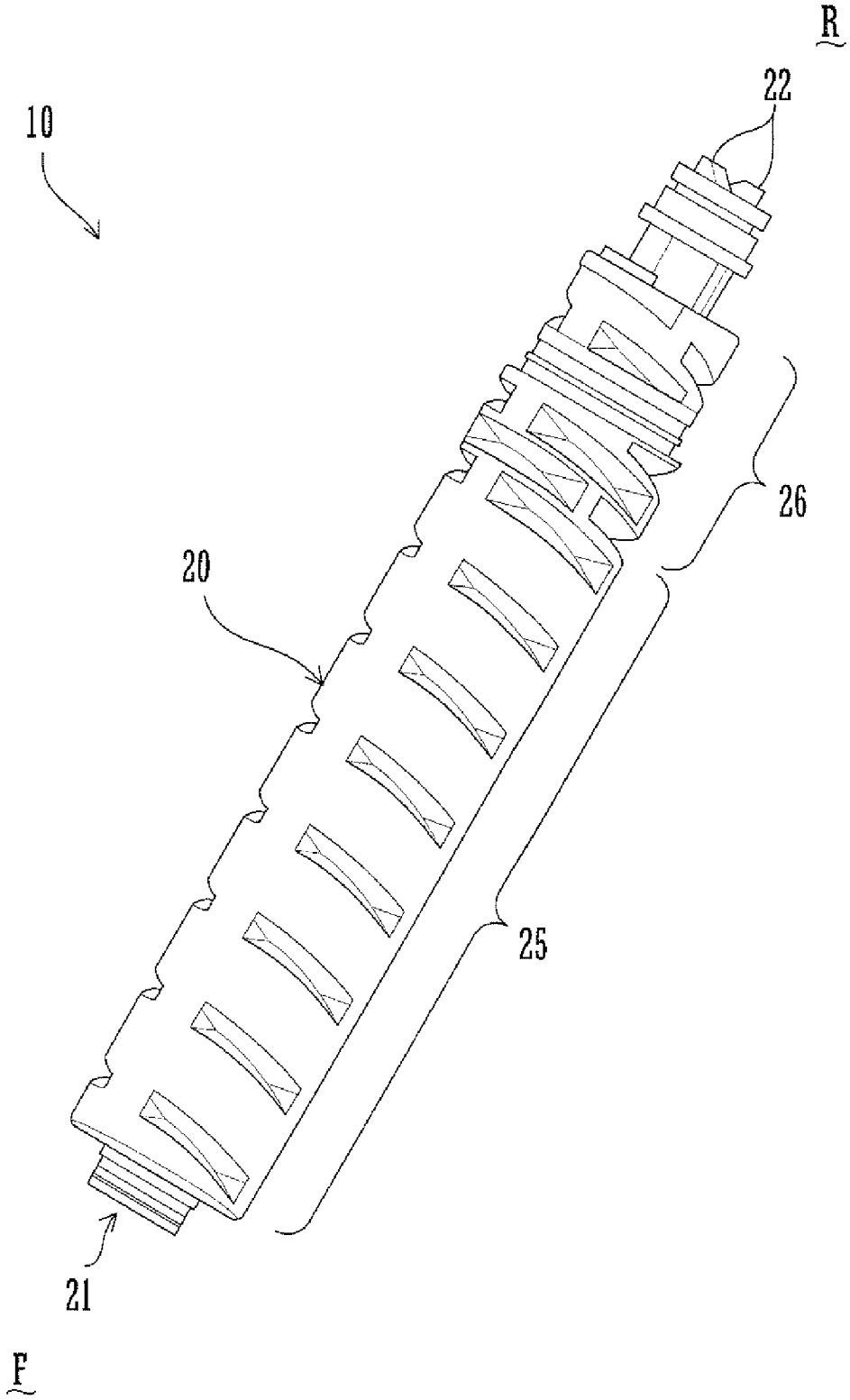
FIG. 2 is a perspective view of a toner bottle of the apparatus for image formation.

Because the toner bottles 10A1, 10A2 and 10B-10D are similar in structure, they will be described below as a toner bottle 10 with reference to FIGS. 2 and 3.

The toner bottle 10 has a cylindrical body 20 and a scraper 30. The bottle body 20 is supported rotatably on its axis by the associated bottle holder and has an opening 21, a pair of connectors 22, a number of ribs 23, and a protrusion 24.

The opening 21 is formed at the front (F) end of the bottle body 20 coaxially with this body. The diameter of the opening 21 is smaller than the inner diameter of the bottle body 20.

The connectors 22 protrude from the rear (R) end of the bottle body 20. The driving shafts of the driving sources 311A1, 311A2 and 311B-311D engage with the connectors 22 of the toner bottles 10A1, 10A2 and 10B-10D respectively so as to rotate the bodies 20 of the bottles and restrict the radial movement of the bodies 20.

The ribs 23 are formed on the inner cylindrical surface of the body 20 of the toner bottle 10 and inclined with respect to the axis of the body 20 so as to convey toner toward the opening 21 when the body 20 rotates. The circumferential length of each rib 23 may be equal to or shorter than half of the circumference of the bottle body 20.

The bottle body 20 includes a front section 25 and a rear section 26 and further has a circumferential ridge 27 formed on its inner cylindrical surface in the rear section. The circumferential ridge 27 is smaller in inner diameter than the front section 25.

Figure 3:
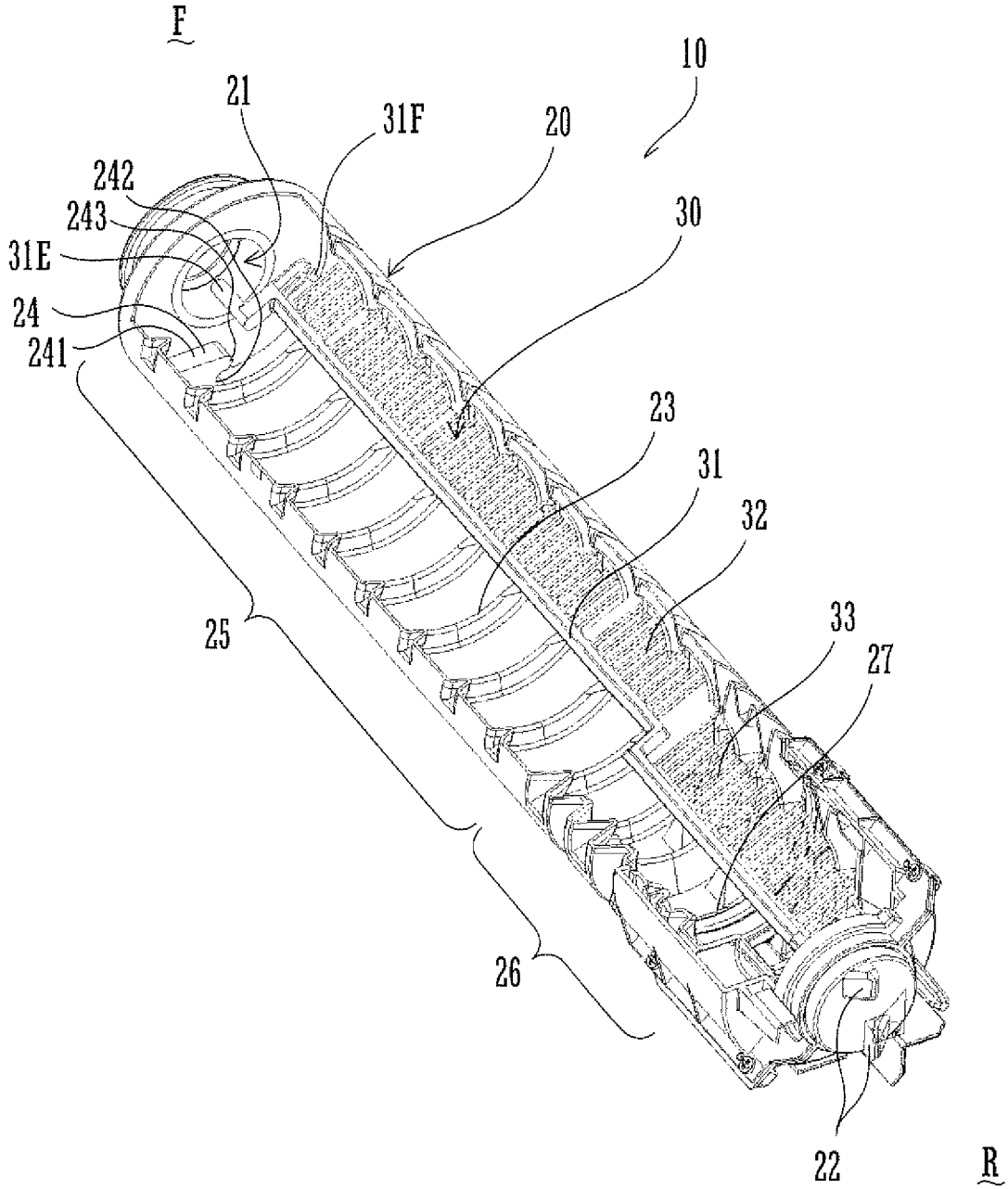
FIG. 3 is a cutaway perspective view of the toner bottle.
Figure 4:
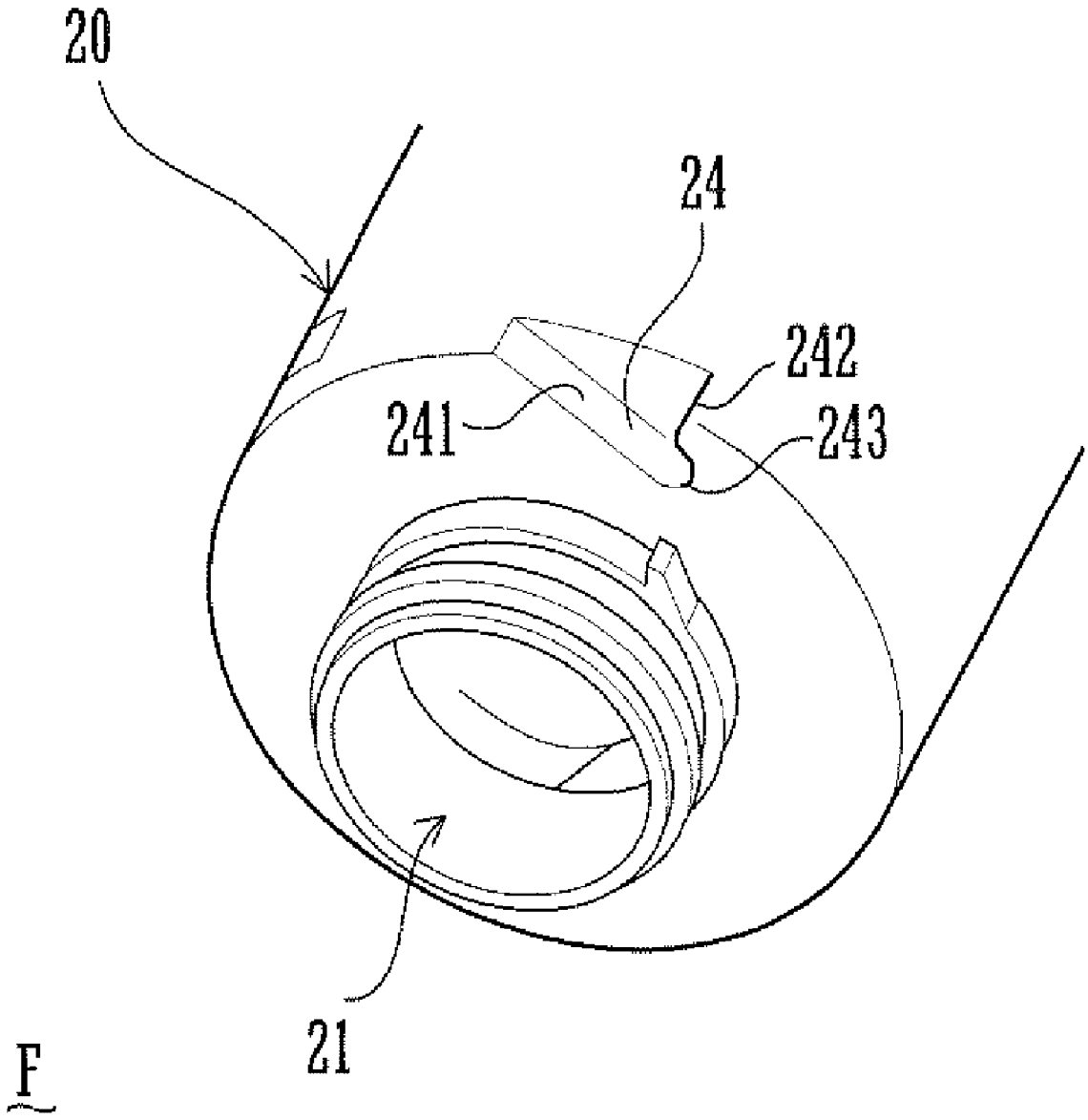
FIG. 4 is a fragmentary perspective view of the toner bottle.
Figure 7:
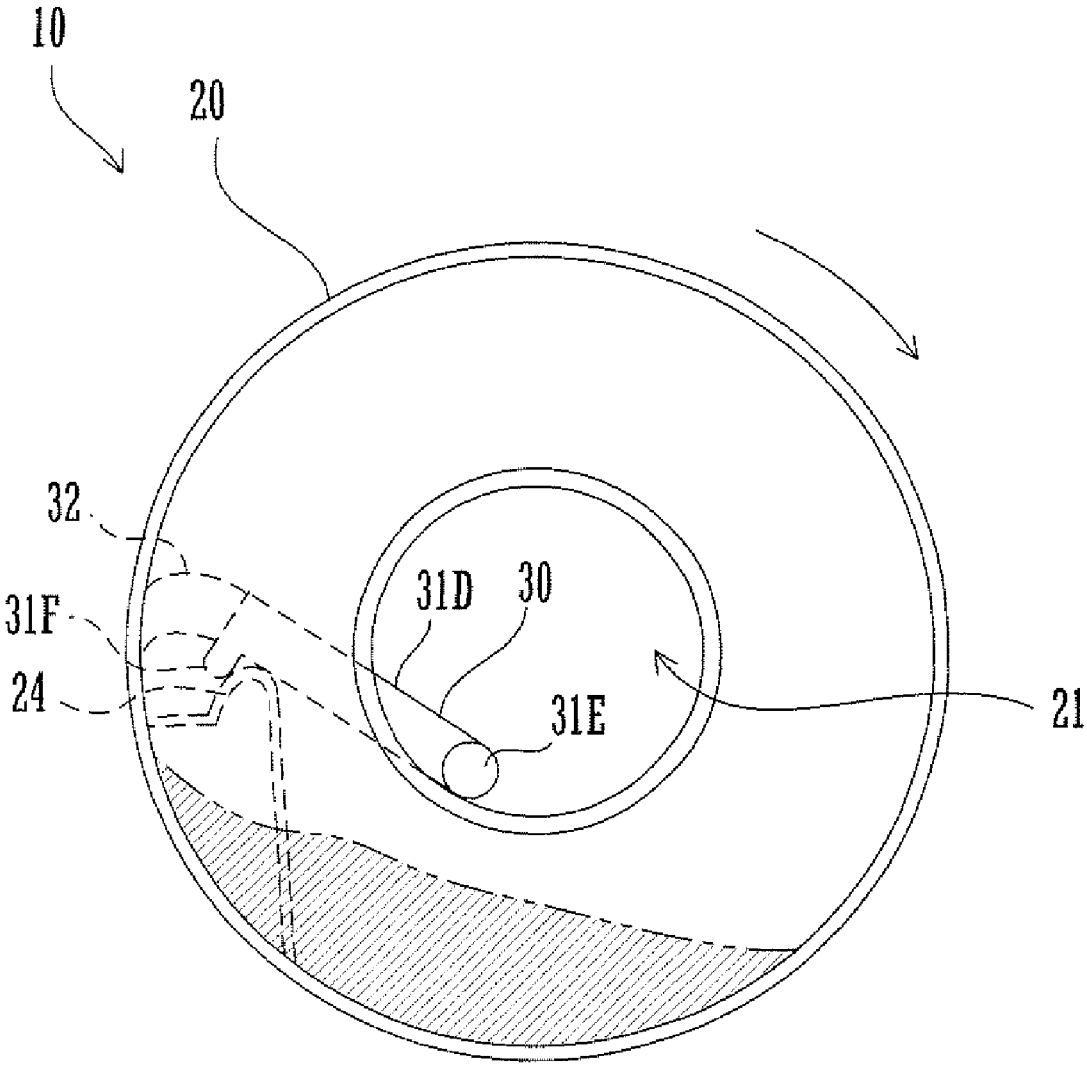

As shown in FIGS. 3 and 4, the protrusion 24 is formed on the inner cylindrical surface of the front end of the bottle body 20 and has a slope 241, a leading end face 242, and an overhang 243. The slope 241 slopes up away from the inner cylindrical surface of the bottle body 20 in the bottle rotating direction. The end face 242 is substantially perpendicular to the inner cylindrical surface. The overhang 243 protrudes in the rotating direction from the end face 242. With reference to FIG. 7, the overhang 243 makes it easy for the protrusion 24 to engage with the scraper 30.

Figure 5:
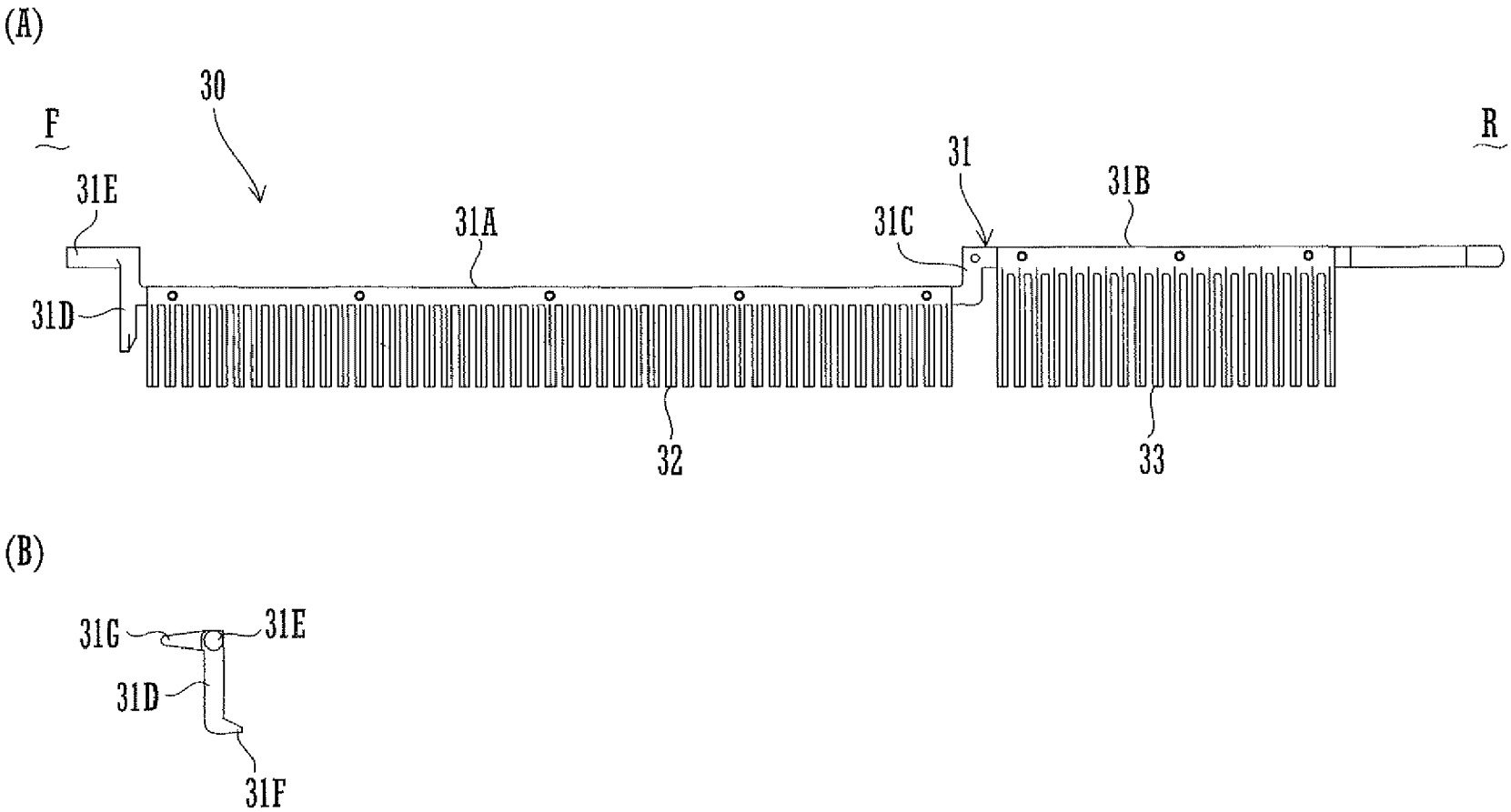
FIGS. 5A and 5B are a side view and a front view respectively of the scraper of the toner bottle.
Figure 6:
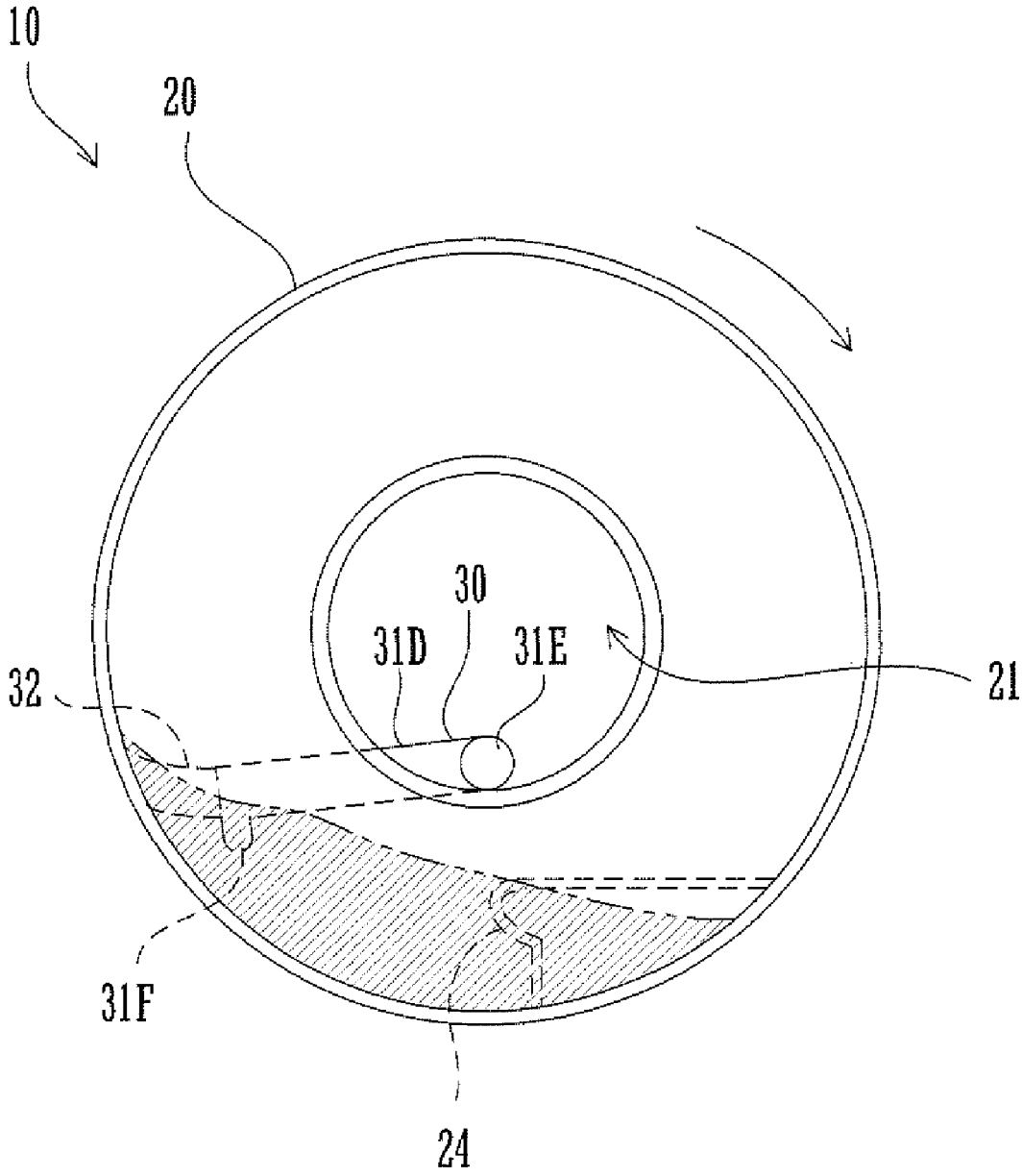
FIGS. 6-9 are front views of the toner bottle, showing how the scraper shifts when the bottle rotates.

With reference to FIGS. 3, 5A and 5B, the scraper 30 consists of a shaft 31, a first scraping part 32 (not shown in FIG. 5B), and a second scraping part 33 (not shown in FIG. 5B). The shaft 31 extends over the whole length of the bottle body 20. The scraping parts 32 and 33 scrape the inner cylindrical surface of the bottle body 20 over the whole length of the body.

The shaft 31 consists of a first supporting part 31A, a second supporting part 31B, a connecting part 31C, a front end part 31D, a front extension 31E, a main engaging part 31F, and an auxiliary engaging part 31G.

The supporting parts 31A and 31B are positioned in the sections 25 and 26 respectively of the bottle body 20. The supporting parts 31A and 31B are parallel to each other and connected by the connecting part 31C. The connecting part 31C and front end part 31D are parallel to each other and perpendicular to the supporting parts 31A and 31B. The middle of the front end part 31D is fixed to the front end of the first supporting part 31A. The front extension 31E is aligned with the second supporting part 31B and extends from one end of the front end part 31D toward the front end of the bottle body 20. The engaging parts 31G and 31F protrude in opposite directions from this end and the other end respectively of the front end part 31D perpendicularly to the supporting parts 31A and 31B, connecting part 31C, end part 31D, and front extension 31E.

The scraper 30 is placed in the bottle body 20, with the front extension 31E positioned in the opening 21, and with the rear end of the shaft 31 positioned in the cylindrical space (not shown) formed in the rear end of the bottle body 20. The front end part 31D is positioned near the back side of the front end of the bottle body 20, keeping the scraper 30 from falling out of this body through the opening 21.

Each of the scraping parts 32 and 33 takes the form of a comb and may be made of polyethylene terephthalate resin. The scraping parts 32 and 33 are elastic and high in strength and do not react chemically to toner.

The bases of the scraping parts 32 and 33 are fixed to the supporting parts 31A and 31B respectively. The bases of the scraping parts 32 and 33 may be stuck on the supporting parts 31A and 31B respectively with double-coated tape and subsequently heat-sealed on them at intervals. The teeth of the scraping parts 32 and 33 extend in parallel to the connecting part 31C and front end part 31D from the supporting parts 31A and 31B respectively.

The free ends of the teeth of the scraping parts 32 and 33 are aligned in parallel to the supporting parts 31A and 31B, so that the teeth of the first scraping part 32 are shorter than the teeth of the second scraping part 33. Accordingly, the scraping parts 32 and 33 differ in elasticity. The teeth of the first scraping part 32 are in compressive contact with the inner cylindrical surface of the bottle body 20 so as to scrape off the toner on the surface. The teeth of the second scraping part 33 can easily get deep into narrow spaces in the bottle body 20 so as to scrape off the toner in them.

FIGS. 6-9 show how the scraper 30 shifts when the bottle body 20 rotates. In FIGS. 6-9, the auxiliary engaging part 31G is not shown.

The scraper 30 is placed in the bottle body 20, with the teeth of the scraping parts 32 and 33 downstream from the supporting parts 31A and 31B in the bottle rotating direction, and with the main engaging part 31F downward. The scraper 30 is not fixed to the bottle body 20 but can move perpendicularly to the axis of the body.

Each of the driving sources 311A1, 311A2 and 311B-311D rotates the bottle body 20 of the associated toner bottle in the bottle rotating direction. When the bottle body 20 rotates, the protrusion 24 engages with the main engaging part 31F, moving the scraper 30 perpendicularly to the axis of the body 20. This moves the front extension 31E along the cylindrical surface of the opening 21, with the scraping parts 32 and 33 kept in compressive contact with the inner cylindrical surface of the bottle body 20 so as to scrape this surface.

As shown in FIG. 7, the protrusion 24 rises as the bottle body 20 rotates. During at least part of the period when the protrusion 24 rises, the protrusion 24 engages with the main engaging part 31F, raising the scraper 30.

As stated already, the scraper 30 is not fixed to the bottle body 20, and the protrusion 24 and main engaging part 31F are positioned near the front end of the body 20. Accordingly, when the protrusion 24 raises the scraper 30, the scraping parts 32 and 33 tend to move at speeds different from the peripheral speed at which the inner cylindrical surface of the bottle body 20 rotates. As a result, when the scraper 30 rises, the scraping parts 32 and 33 scrape off the toner sticking to the inner cylindrical surface of the bottle body 20.

When the scraper 30 rises, the scraping parts 32 and 33 are in compressive contact with the inner cylindrical surface of the bottle body 20, so that they easily scrape off the toner sticking to the parts of this surface which lie between the ribs 23 etc.

Figure 8:
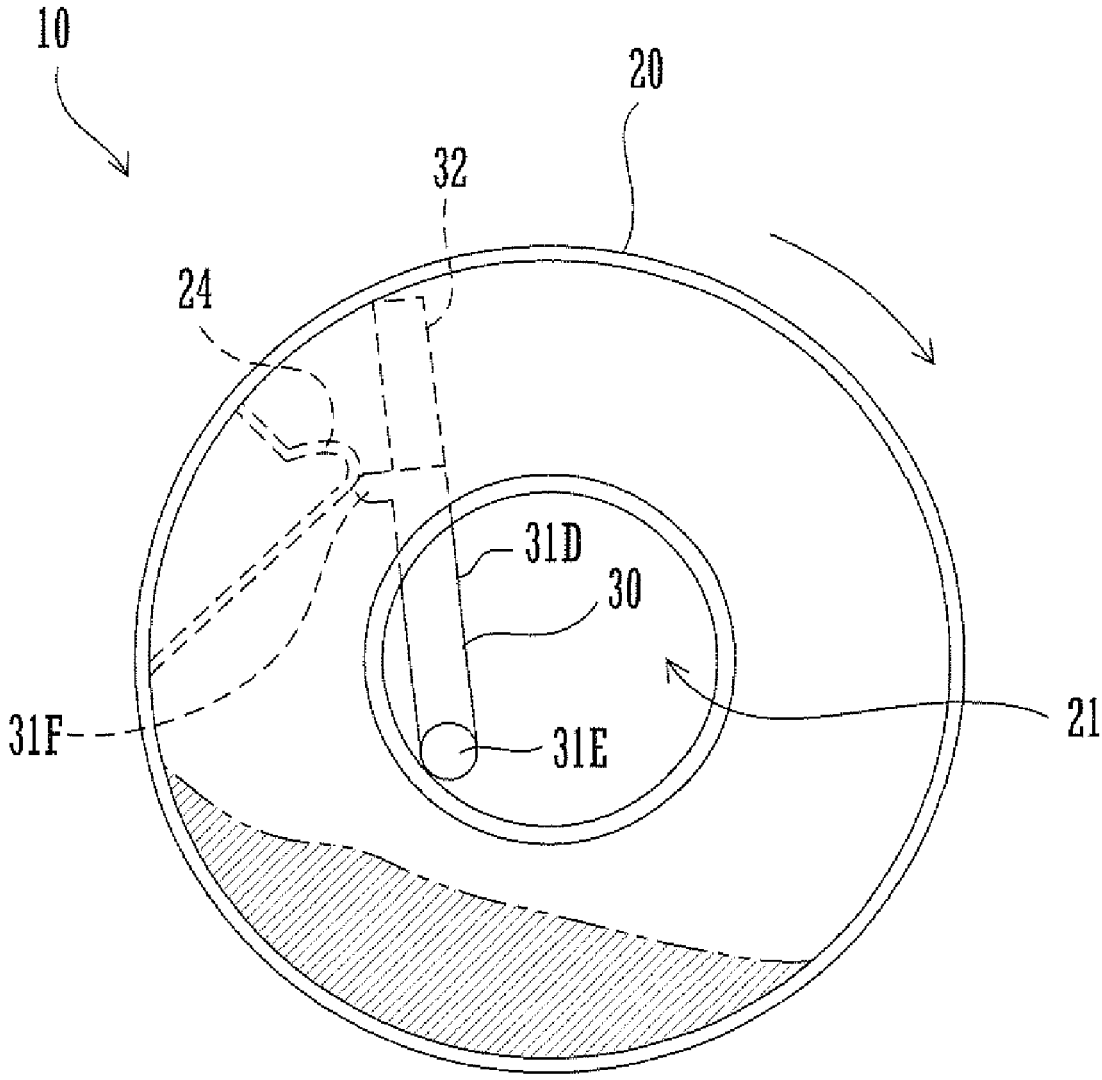
Figure 9:
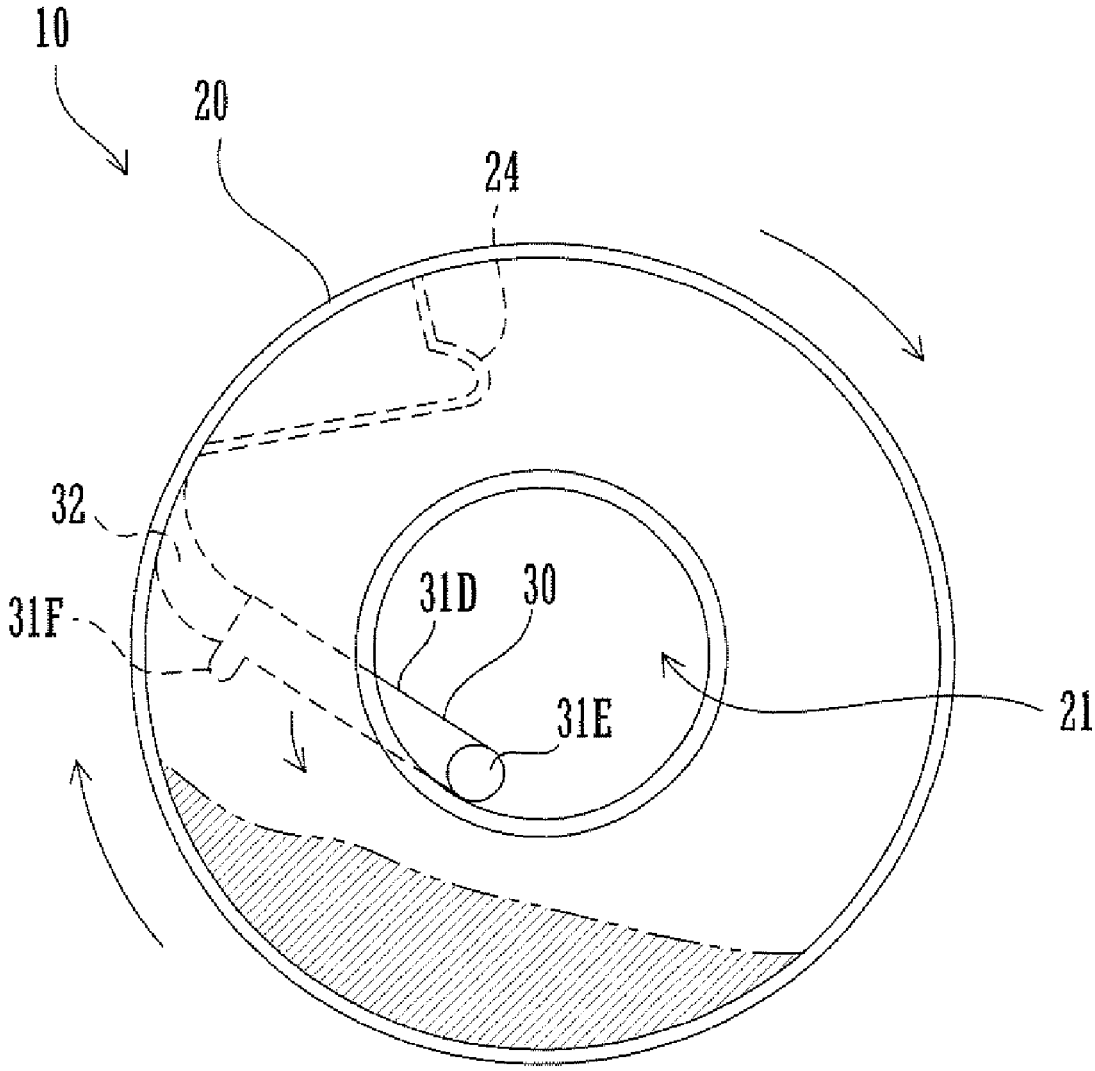

As shown in FIG. 8, before the scraper 30 would pass its vertical position and incline to the opposite side, the main engaging part 31F disengages from the protrusion 24. Consequently, as shown in FIG. 9, the scraper 30 falls by gravity, with the scraping parts 32 and 33 scraping the inner cylindrical surface of the bottle body 20.

When the scraper 30 falls, it keeps inclining to the same side as before the main engaging part 31F disengages from the protrusion 24. Accordingly, the scraper 30 scrapes the inner cylindrical surface of the bottle body 20 while moving in the direction opposite to the direction in which this surface rotates. This makes it possible to efficiently scrape off the toner on the inner cylindrical surface of the bottle body 20.

When the scraper 30 falls, it smashes and loosens the toner lying in the bottle body 20. When the scraper 30 repeatedly rises and falls, it vibrates the toner in the bottle body 20, thereby loosening the toner. In the meantime, the toner sticking to the scraper 30 falls.

As stated already, when the bottle body 20 rotates, the scraper 30 moves perpendicularly to the axis of this body. At least when the scraper 30 falls, the scraping parts 32 and 33 scrape off the toner on the inner cylindrical surface of the bottle body 20 over the whole length of the body. This improves the flowability of the toner in the bottle body 20, restraining the toner from cohering.

As stated already, the scraper 30 is placed in the bottle body 20, with the main engaging part 31F downward. As stated already, the engaging parts 31F and 31G protrude in opposite directions.

The scraper 30 might be placed in the bottle body 20, with the main engaging part 31F upward, and with the teeth of the scraping parts 32 and 33 upstream from the supporting parts 31A and 31B in the bottle rotating direction. In this case, when the bottle body 20 rotates, the protrusion 24 would engage with the auxiliary engaging part 31G, moving the scraper 30 perpendicularly to the axis of the body 20, with the scraping parts 32 and 33 scraping the inner cylindrical surface of this body.

However, if the scraper 30 is placed in the bottle body 20, with the main engaging part 31F downward, the scraping parts 32 and 33 move higher than if the scraper 30 is placed with this engaging part 31F upward. This more effectively restrains the cohesion of the toner in the bottle body 20.

As stated already, the protrusion 24 and main engaging part 31F disengage from each other before the scraper 30 inclines to the opposite side.

The protrusion 24 and main engaging part 31F might disengage from each other after the scraper 30 passes its vertical position and inclines to the opposite side. In this case, the scraper 30 would fall on this side (right side in FIGS. 6-9), with the scraping parts 32 and 33 scraping the inner cylindrical surface of the bottle body 20. The scraping parts 32 and 33 would move in the same direction as the inner cylindrical surface rotates and at a speed different from the peripheral speed at which this surface rotates. Accordingly, the scraping parts 32 and 33 would scrape off the toner on the inner cylindrical surface less effectively for a shorter distance.

If the protrusion 24 and main engaging part 31F disengage from each other before the scraper 30 inclines to the opposite side, the scraping parts 32 and 33 move in the direction opposite to the direction in which the inner cylindrical surface of the bottle body 20 rotates, as stated already. Accordingly, the scraping parts 32 and 33 scrape the toner on the inner cylindrical surface effectively for a longer distance.

The bottle body 20 might have two or more protrusions (24) formed at circumferential intervals on its inner cylindrical surface. This would increase the frequency at which the scraper 30 rises and falls. The increased frequency would increase the frequency at which the scraper 30 scrapes off the toner sticking to the inner cylindrical surface of the bottle body 20 and smashes and loosens the toner collecting in this body. As a result, the toner in the bottle body 20 would be restrained more effectively from cohering.

The technology can also be applied to a toner bottle having an opening (21) formed midway between its ends.

The scraping parts 32 and 33 might be replaced by one scraping part or three or more scraping parts.

It will be obvious that the technology may be varied in many ways. Such variations are not to be regarded as a departure from the spirit and scope of the technology, and all such modifications as would be obvious to one skilled in the art are intended to be included within the scope of the following claims.

What is claimed is:

1. A toner bottle for containing toner, the bottle comprising:

a cylindrical body rotatable on an axis thereof in a rotating direction by means of a driving source;

the cylindrical body having an opening, through which the toner is supplied to a developing unit;

the cylindrical body further having ribs for conveying the toner toward the opening when the body rotates; and a scraper supported movably in the cylindrical body;

the scraper being movable perpendicularly to the axis when the cylindrical body rotates;

the scraper including a shaft extending over the whole length of the cylindrical body;

the scraper further including a scraping part supported by the shaft;

wherein a portion of the scraping part is in contact with the inner cylindrical surface of the cylindrical body, wherein the cylindrical body further has a protrusion formed on the inner cylindrical surface, and wherein the scraper further includes an engaging part for engaging with the protrusion when the cylindrical body rotates.

2. A toner bottle as claimed in claim 1, wherein the axis of the cylindrical body is substantially horizontal;

the protrusion and the engaging part being adapted to engage with each other during at least part of the period when the protrusion rises as the cylindrical body rotates;

the protrusion and the engaging part being also adapted to disengage from each other before the scraper inclines to the opposite side.

3. A toner bottle as claimed in claim 1, wherein the protrusion is positioned at one end of the cylindrical body and the engaging part is positioned at one end of the scraper.

4. A toner bottle as claimed in claim 1, wherein the protrusion has:

a slope sloping up away from the inner cylindrical surface of the cylindrical body in the rotating direction;

a leading end face substantially perpendicular to the inner cylindrical surface; and an overhang protruding from the leading end face in the rotating direction.

5. A toner bottle as claimed in claim 1, wherein the scraping part takes the form of a comb.

6. A toner bottle as claimed in claim 1, wherein the scraping part is made of polyethylene terephthalate resin.

7. A toner bottle as claimed in claim 1, wherein the shaft of the scraper comprises a first supporting part and a second supporting part, the second supporting part extending in a direction parallel to the first supporting part and being offset laterally from the first supporting part.

8. A toner bottle as claimed in claim 7, wherein the scraping part of the scraper comprises a first scraping part that is attached to and extends from the first supporting part of the shaft, and a second scraping part that is attached to and extends from the second supporting part of the shaft, and wherein a length of the second scraping part in a direction perpendicular to the shaft is greater than a length of the first scraping part in a direction perpendicular to the shaft.

9. A toner bottle for containing toner, the bottle comprising:

a cylindrical body rotatable on an axis thereof in a rotating direction by means of a driving source;

the cylindrical body having an opening, through which the toner is supplied to a developing unit;

the cylindrical body further having ribs for conveying the toner toward the opening when the body rotates; and a scraper supported movably in the cylindrical body;

the scraper being movable perpendicularly to the axis when the cylindrical body rotates;

the scraper including a shaft extending over the whole length of the cylindrical body;

the scraper further including a scraping part supported by the shaft;

wherein a portion of the scraping part is in contact with the inner cylindrical surface of the cylindrical body, and wherein the opening in the cylindrical body comprises a cylindrical opening surface that is substantially concentric with an outer wall of the cylindrical body, a diameter of the cylindrical opening surface being smaller than a diameter of the cylindrical body, wherein a front extension extends from a front end of the shaft of the scraper, and wherein the front extension is located in the cylindrical opening surface.

10. A toner bottle for containing toner, the bottle comprising:

a cylindrical body rotatable on an axis thereof in a rotating direction by means of a driving source;

the cylindrical body having an opening, through which the toner is supplied to a developing unit;

the cylindrical body further having ribs for conveying the toner toward the opening when the body rotates; and a scraper supported movably in the cylindrical body;

the scraper being movable perpendicularly to the axis when the cylindrical body rotates;

the scraper including a shaft extending over the whole length of the cylindrical body;

the scraper further including a scraping part supported by the shaft;

wherein a portion of the scraping part is in contact with the inner cylindrical surface of the cylindrical body, wherein the shaft of the scraper comprises a first supporting part and a second supporting part, the second supporting part extending in a direction parallel to the first supporting part and being offset laterally from the first supporting part.

11. A toner bottle as claimed in claim 10, wherein the scraping part of the scraper comprises a first scraping part that is attached to and extends from the first supporting part of the shaft, and a second scraping part that is attached to and extends from the second supporting part of the shaft, and wherein a length of the second scraping part in a direction perpendicular to the shaft is greater than a length of the first scraping part in a direction perpendicular to the shaft.

* * * * *